United States Patent [19]

Johansson

[11] Patent Number: 5,002,656

[45] Date of Patent: Mar. 26, 1991

[54] ROTARY GRID-STRUCTURE BUCKET FOR SEPARATING FROM EACH OTHER FINE AND COARSE PARTICLES OF SIZABLE MATERIALS OR PRODUCTS

[76] Inventor: Hans A. V. Johansson, Farstorp, S-241 00 Eslöv, Sweden

[21] Appl. No.: 173,551

[22] Filed: Mar. 25, 1988

[30] Foreign Application Priority Data

Mar. 30, 1987 [SE] Sweden ..... 8701311

[51] Int. Cl.[5] ..... B07B 1/22

[52] U.S. Cl. ..... 209/421; 209/254; 209/288; 209/407

[58] Field of Search ..... 209/260, 284, 288, 401, 209/403, 406, 407, 420, 421, 664, 683, 935, 254

[56] References Cited

U.S. PATENT DOCUMENTS

| | | | |
|---|---|---|---|
| 248,242 | 10/1881 | Watrous | 209/284 |
| 338,847 | 3/1886 | Krom | 209/407 |
| 683,775 | 10/1901 | Kirkpatrick . | |
| 928,965 | 7/1909 | Hanna . | |
| 1,793,389 | 2/1931 | Elmer . | |
| 2,119,676 | 6/1938 | Heller . | |
| 2,422,985 | 7/1944 | Reckler . | |
| 2,882,976 | 11/1955 | Wheeler et al. . | |
| 3,003,265 | 10/1961 | Lutjens . | |
| 3,033,394 | 5/1962 | Kashergen . | |
| 3,072,257 | 1/1963 | Hockenberry . | |
| 3,208,593 | 9/1965 | Dietert | 209/288 |
| 3,231,246 | 1/1966 | Deen et al. . | |
| 3,431,662 | 3/1969 | Bles . | |
| 3,461,968 | 8/1969 | Longley | 209/421 |
| 3,765,490 | 10/1973 | Logue . | |
| 4,005,755 | 2/1977 | Bakke et al. . | |
| 4,018,675 | 4/1977 | Petrucci . | |
| 4,157,956 | 6/1979 | Robinson . | |
| 4,805,703 | 2/1989 | Carlsson | 171/132 |

FOREIGN PATENT DOCUMENTS

| | | | |
|---|---|---|---|
| 178656 | 4/1986 | European Pat. Off. . | |
| 767207 | 2/1952 | Fed. Rep. of Germany | 209/407 |
| 3101606 | 8/1982 | Fed. Rep. of Germany . | |
| 3403818 | 8/1984 | Fed. Rep. of Germany . | |
| 486732 | 7/1966 | France . | |
| 540905 | 2/1983 | France . | |
| 58-10955 | of 1983 | Japan . | |
| 800181 | 8/1981 | Norway . | |
| 82/01022 | 4/1982 | PCT Int'l Appl. . | |
| 1291555 | 10/1972 | United Kingdom . | |
| 1512206 | 5/1978 | United Kingdom . | |

OTHER PUBLICATIONS

New Machinery and Equipment–Rock Products—p. 96 (undated).

*Primary Examiner*—Margaret A. Focarino
*Assistant Examiner*—Gary C. Hoge
*Attorney, Agent, or Firm*—Foley & Lardner, Schwartz, Jeffery, Schwaab, Mack, Blumenthal & Evans

[57] ABSTRACT

A rotary grid-structure bucket for separating fine and coarse constituents of sizable materials or products, has a bucket (3) with a separating part (9) located between its back (7) and its front (8) and sides provided with apertures to allow fine constituents (4) of the sizable materials or products (6) to pass therethrough. To make it possible for the separating part (9) to be exploited in its entire length the sides of the separating part diverge symmetrically with respect to the axis of rotation (R) in a forward direction. Ahead of the separating part (9) the bucket has a front part (25) whose sides diverge around the axis of rotation (R) in a forward direction in a lesser degree in relation to the axis of rotation (R) than the sides of the separating part (9) or extend in parallel with the axis of rotation (R) or converge in relation to the axis of rotation (R). The implement carrier (1, 2) is adapted to maintain the bucket (3) during rotation such that the momentarily lowermost portion (9*a*) of the sides of the separating part (9) as seen from the side extend horizontally (H) while the portion (25*a*) of the sides of the front part (25), which is momentarily lowermost during rotation as seen from the side, extend in an upward direction (U), resulting in distribution of the sizable materials or products (6) during rotation of the bucket (3) along the separating part (9), while the sizable materials or products (6) are prevented from falling out through the front (8) of the bucket (3) in that the momentarily lowermost portion (25*a*) of the sides of the front part (25) forms a threshold ahead of the separating part (9).

18 Claims, 8 Drawing Sheets

ROTARY GRID-STRUCTURE BUCKET FOR SEPARATING FROM EACH OTHER FINE AND COARSE PARTICLES OF SIZABLE MATERIALS OR PRODUCTS

This invention relates to a rotary grid-structure bucket for separating from each other fine and coarse particles of sizable materials or products, the back of the bucket comprising coupling means for coupling the bucket to an implement carrier, such as a wheeled loader, an excavator loader, an excavating machine or a tractor equipped with a loading assembly, the front of the bucket being open for collection of the sizable materials or products in the bucket, the bucket comprising a separating part located between the back and the front and having sides with apertures therein for allowing the fine constituents of the sizable materials or products to escape therethrough, the implement carrier being adapted to cause the bucket to perform shifting movements, lifting movements and tilting movements for collection, lifting and tilting of the sizable materials or products, the bucket cooperating with a rotation assembly for rotating the bucket in relation to the implement carrier about an axis of rotation with extends in a forward direction from the back of the bucket to the front thereof, and the bucket imparting, through its rotation, movement to the sizable materials or products in the bucket, thus causing the fine constituents to drop out of the apertures in the sides of the separating part.

A rotary bucket of the abovementioned design is disclosed in U.S. Pat. No. 4,805,703 to Carlsson. It has proved that the bucket described and shown in this publication must be kept directed, during its rotation, at a rather great inclination obliquely forwardly and upwardly to prevent the sizable materials or products falling out through the open front of the bucket. This implies, however, that the materials or products slide to the rear of the bucket, accumulating in a pocket at the back, from which the fine constituents will then drop out. By reason of the accumulation of the materials or products at the rear of the bucket in this manner instead of being distributed all over the bucket, only a small part of the bucket length will be exploited, with the result that the contemplated sizing effect cannot be attained.

The object of the present invention is to eliminate this problem and to provide a rotary bucket of the above type which makes it possible to distribute the materials or products over the entire bucket length without risking that they will unintentionally escape through the open front of the bucket.

By designing the bucket in conformity with said characteristic features and maintaining it directed in the indicated manner during rotation, the materials or products will be distributed over the entire length of the separating part of the bucket and the front part of the bucket will form a threshold which prevents the materials or products from unintentionally falling out through the open front of the bucket.

The invention will be explained more in detail below with reference to the accompanying drawings, in which.

4.

Figure 7:
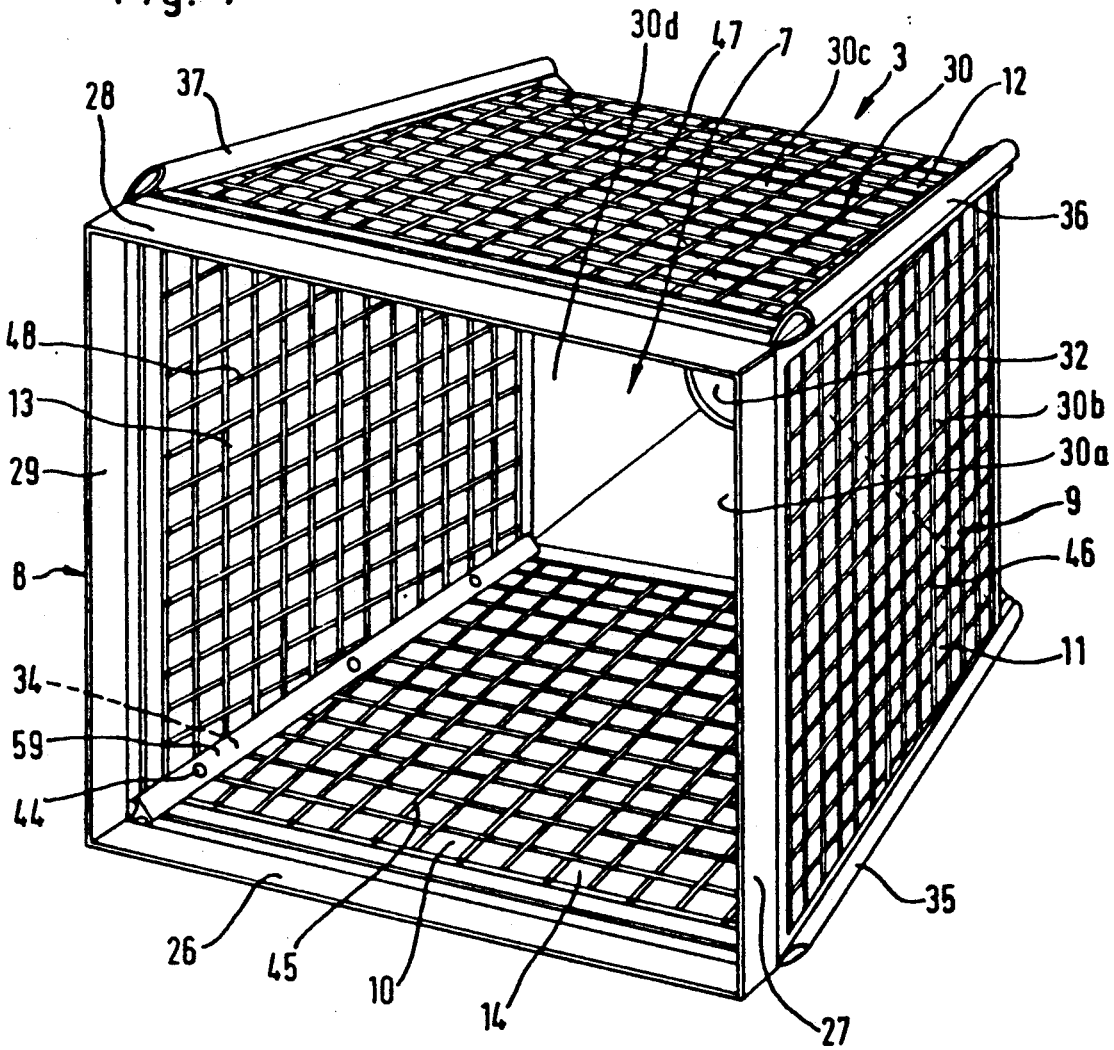
Figure 8:
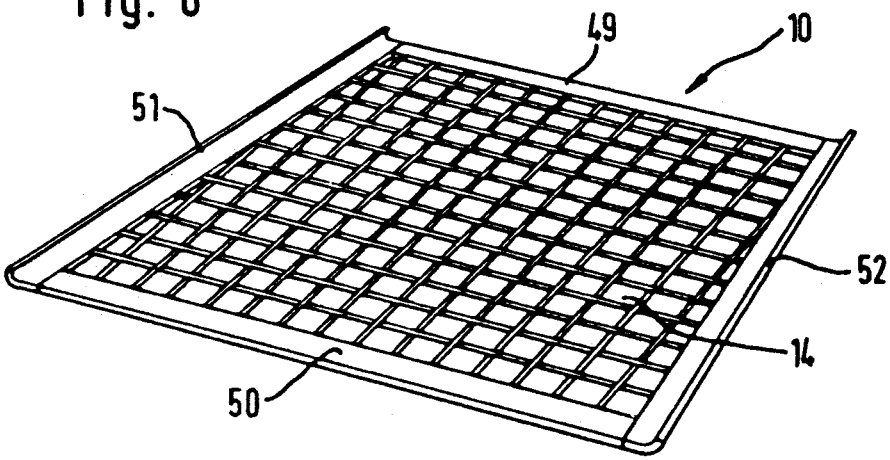
Figure 9:
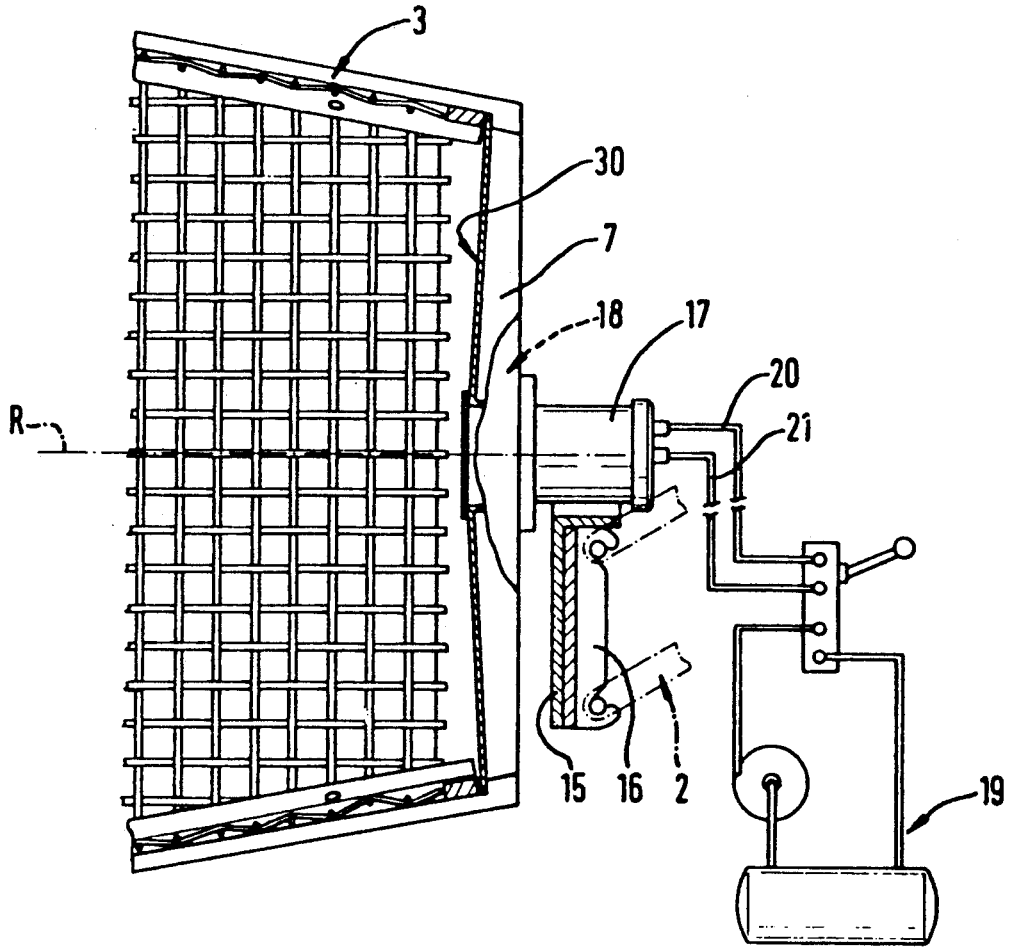
Figure 10:
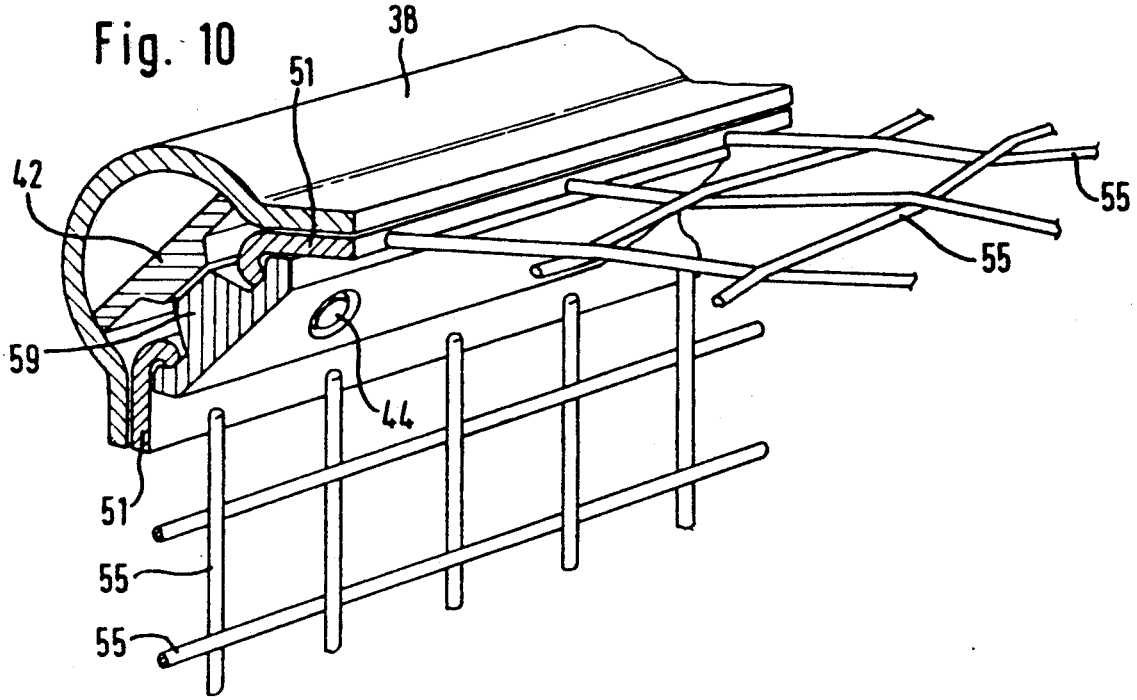
Figure 11:
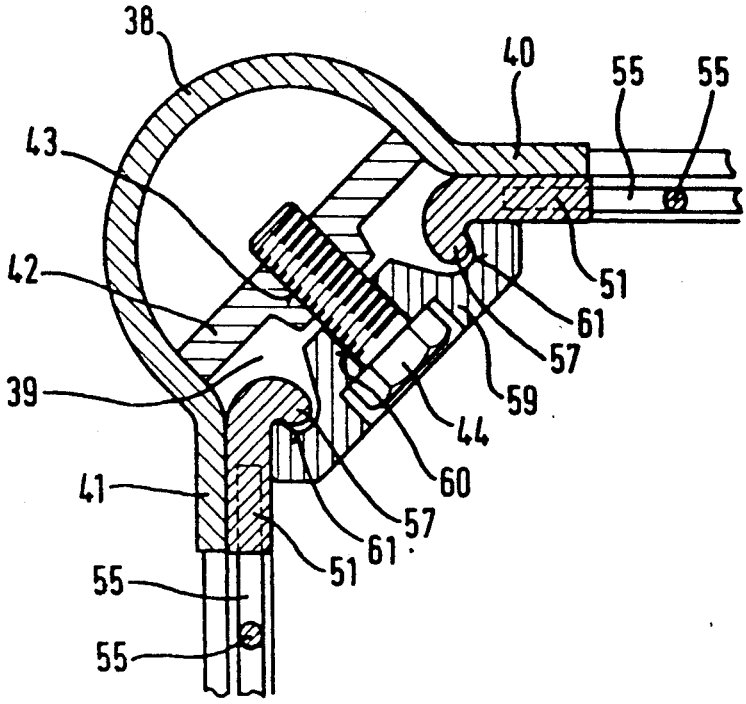
Figure 12:
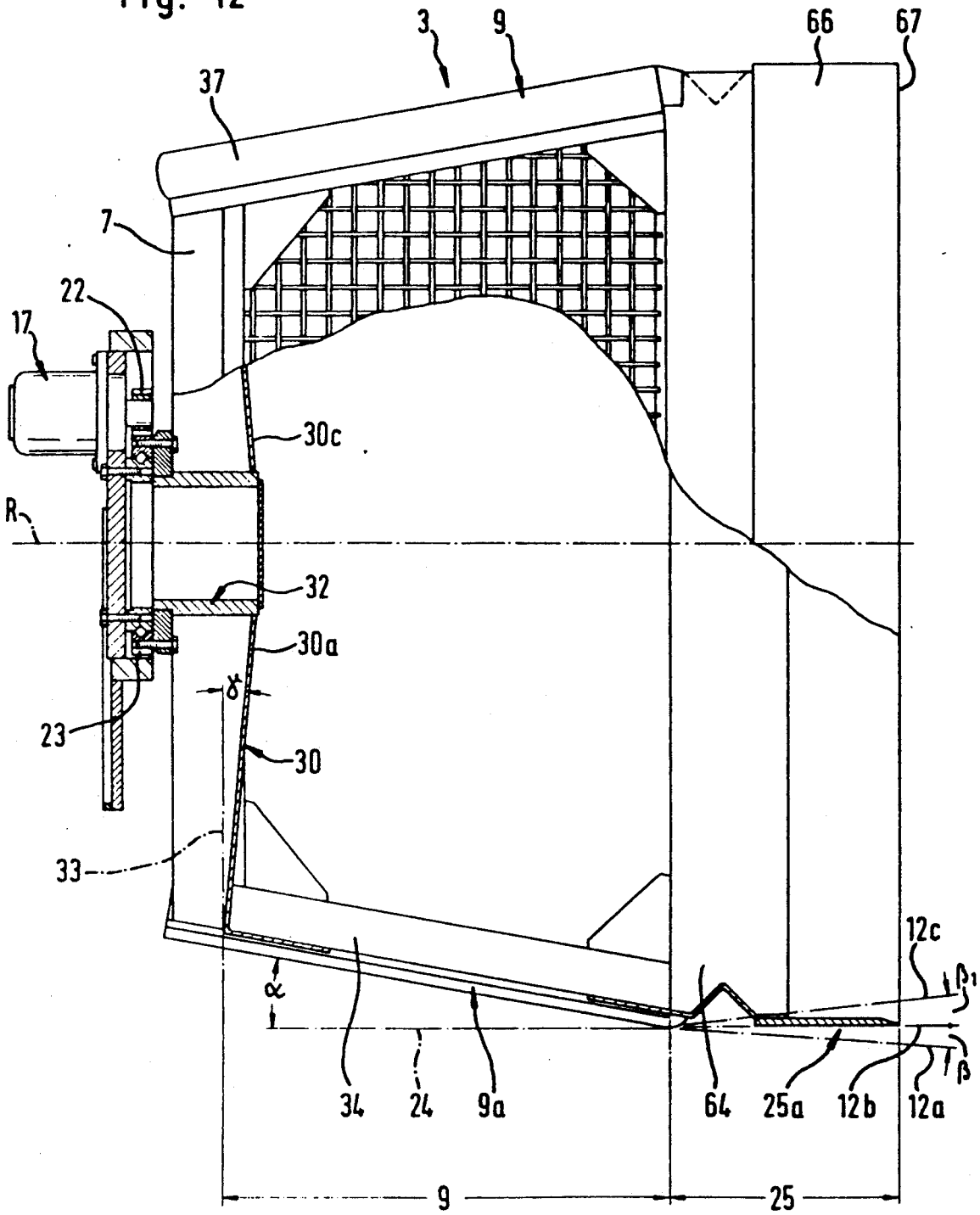
Figure 13:
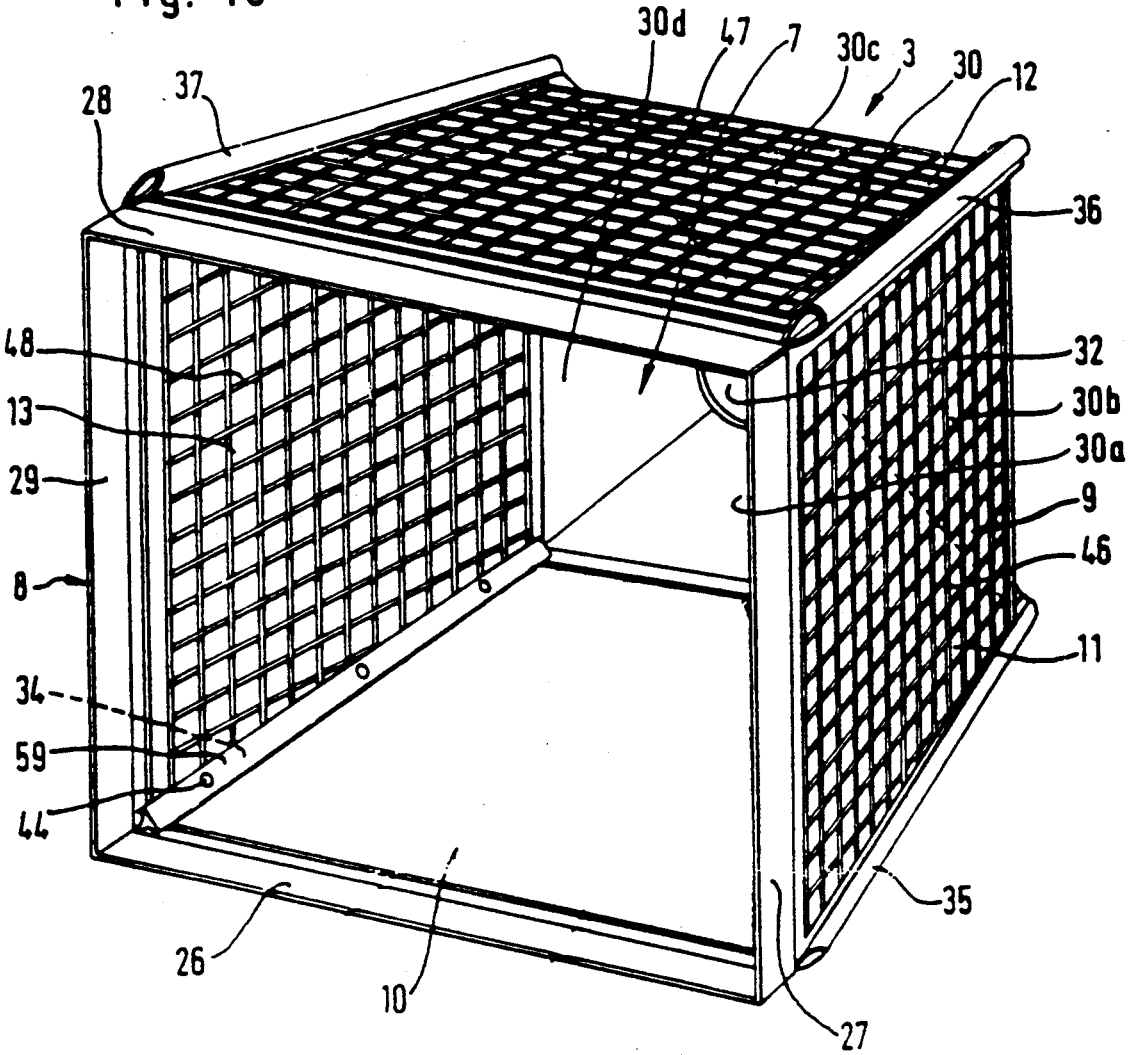
Figure 14:
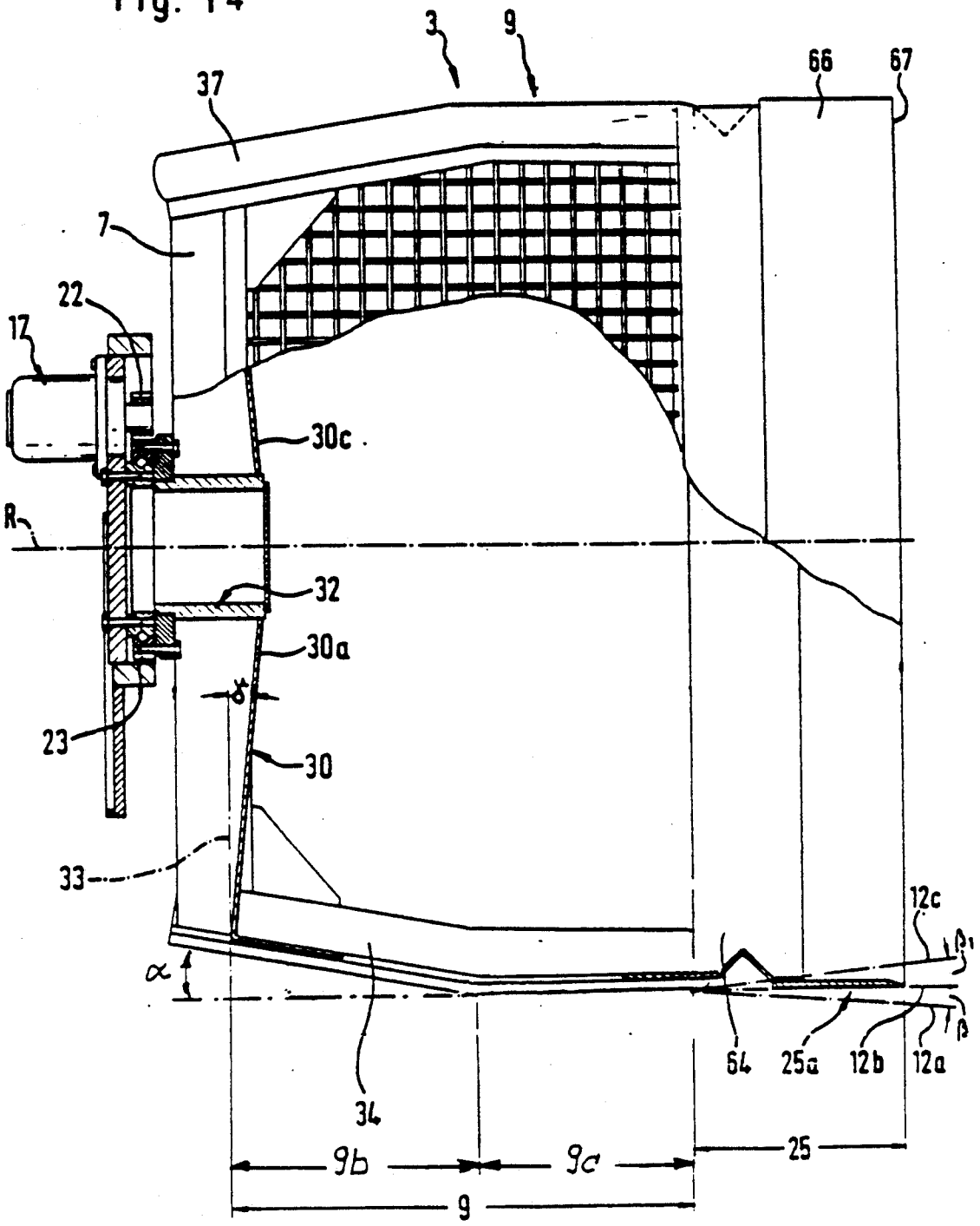

FIG. 7 is a perspective view of the bucket;

FIG. 8 is a perspective view of a dismounted side of the bucket;

FIG. 9 is a side view of part of the bucket and a diagrammatically shown hydraulic system of the tractor;

FIG. I0 is a perspective view of a corner portion of the bucket;

FIG. 11 is a section of said corner portion;

FIG. 12 is a side view of a bucket and a rotation assembly mounted in a slightly different manner;

FIG. 13 is a perspective view of the bucket having a substantially closed side of the separating part; and FIG. 14 is a side view showing the front and rear portions of the separating part.

The drawings illustrate an implement carrier 1 in the form of a tractor 1 with a conventional loading assembly 2 which is adapted to be coupled to a rotary bucket 3 of grid structure designed for the separation of fine and coarse constituents 4 and 5, respectively, of sizable materials or products 6. In the following example, there has been chosen as sizable material or product 6 topsoil mingled with stones and roots. The purpose of the sizing is to separate the topsoil, i.e. the fine constituents, from the stones and roots, i.e. the coarse constituents.

As is clearly apparent, for instance from FIG. 7 or 12, the bucket 3 has a preferably closed back 7 and an open front 8. Adjacent the back 7 the bucket 3 has a separating part 9 which in this case is quadrilateral and whose sides 10, 11, 12 and 13 have apertures 14 therein to allow the topsoil 4, but not the stones and roots 5, to pass therethrough.

As shown in FIG. 14, the separating part 9 comprises a rear portion **9*b* closest to the back 7 of the bucket 3 and a front portion 9*c* closest to the front part 25, whereby the front portion 9*d* diverges in a lesser degree than the rear portion 9*b*** relative to the axis of rotation R, extends parallel with the axis of rotation or converges relative to the axis of rotation.

At the back the bucket 3 has a holder 15 with coupling means 16, and a rotation assembly 17. The coupling means 16 are adapted to permit coupling the bucket 3 to the loading assembly 2 while the rotation assembly 17 is adapted to rotate the bucket 3 in relation to the loading assembly 2 about an axis of rotation R which extends centrally through the bucket 3 in a forward direction from the back 7 to the front 8.

In the embodiment shown in FIG. 9 the rotation assembly 17 is centered with the axis of rotation R and drives the bucket 3 via a gear transmission 18 (not shown in detail). The rotation assembly 17 preferably is a so-called hydraulic motor, which is connectable to the hydraulic system 19 of the tractor via conduits 20, 21.

Another location of the rotation assembly 17 is shown in FIG. 12. In this embodiment, the rotation assembly 17 is mounted eccentrically with respect to the axis of rotation R. The gear transmission 18 in this case is a gear 22 on the output shaft of the rotation assembly 17, and said gear 22 drives a toothed rim 23 fixedly mounted on the back 7 of the bucket 3.

The sides 10-13 of the separating part 9 all are of a size and they are symmetrically arranged around the axis of rotation R. Moreover, the sides 10–13 diverge symmetrically with respect to the axis of rotation R in a forward direction, i.e. the separating part 9 widens symmetrically in a forward direction. Each side 10–13 preferably diverges an angle 8°–30°, preferably about 12°, in relation to the axis of rotation R (or a line 24 parallel to the axis of rotation).

Ahead of the separating part 9 the bucket 3 has a front part 25 whose four sides 26–29 constitute forward extensions of the sides 10–13 of the separating part 9.

The sides 26–29 of the front part 25 diverge in a lesser degree with respect to the axis of rotation R than the sides 10–13 of the separating part 9 (according to a dash and dot line 12*a* in FIG. 12) or extend in parallel with the axis of rotation R (the full line 12*b* in FIG. 12) or converge in relation to the axis of rotation R (the dash and dot line 12*c* in FIG. 12). In the embodiment illustrated the angle $\beta$ between the lines 12*a* and 24 is for instance 5° and the angle $\beta 1$ between the lines 24 and 12*c* is for instance also 5°. Furthermore, in the illustrated embodiment, all sides 26–29 of the front part 25 are symmetrically arranged in relation to the axis of rotation and they are of a size, similar and extend at the same angle to the axis of rotation R. Alternatively, however, the sides 26–29 of the front part 25 may be different, one or more of these sides may extend at another angle to the axis of rotation R than the other side or sides 26–29 , and the sides 26–29 may possibly have different shapes.

For the separation of the topsoil 4 from the stones and roots 5 the loading assembly 2 can be set to keep the bucket 3 in a position in which the portion 9*a* of the sides 10–13 of the separating part 9, which is momentarily lowermost during rotation, extends as seen from the side horizontally (along the horizontal line H in FIG. 4) or approximately horizontally, while the portion 25*a* of the sides 26–29 of the front part 25, which is momentarily lowermost during rotation, extends as seen from the side in an upward direction (along the obliquely upwardly extending line U).

As a result, the sizable materials 6 in the bucket 3 will rest during rotation on a lower portion 9*a* of the bucket 3 that extends horizontally, which implies that the sizable materials 6 in the bucket 3 will be distributed over the entire length of the separating part 9 instead of collecting on part of the length of the separating part 9, as was the case earlier.

Figure 4:
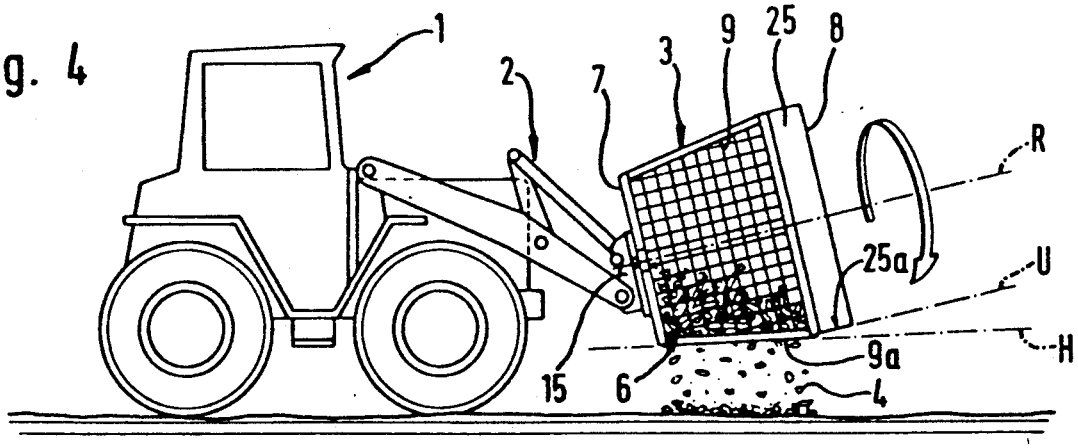
FIG. 4 is a side view of the tractor with the bucket set in the predetermined sizing position and during rotation to cause the fine constituents to fall out.

As will be apparent from FIG. 4, the lowermost portion 25*a* of the front part 25 while rotating is simultaneously upwardly directed such that said lowermost part forms a threshold ahead of the separating part 9, said threshold preventing the sizable materials 6 from falling out through the open front 8 of the bucket 3 when the bucket 3 is rotated for separation of the topsoil 4.

At the rotation of the bucket 3 the materials 6 will be set in motion in such manner that the bucket 3 carries along parts thereof in an upward direction. When these materials 6 then fall down topsoil 4 will effectively be caused to pass through the apertures 14 in the separating part 9 and the topsoil 4 will be distributed uniformly over an area which is as long as the separating part 9. If the tractor besides is propelled during the separating operation a uniform topsoil layer can be spread over a large soil surface.

As will be apparent from FIG. 4, the bucket 3 during this rotation is maintained such that the axis of rotation R points obliquely upwardly and thus the back of the bucket 3 obliquely rearwardly and upwardly. As a result, the materials 6 in the bucket 3 may tend to "hang on" to the back 7 or in any case the materials 6 may not fall down along the back 7 in the desired manner. To counteract this, the inside 30 of the bucket 3 consists of four triangular parts 30*a*–30*d* which together form a pyramidal inner part of the bucket. The parts 30*a*–30*d* open into central parts 32 of the inside 30 and said central parts may be polygonal or circular, as shown in the drawings. As the inside 30 has this pyramidal shape, i.e. comprising a plurality of triangular parts 30*a*–30*d* which do not lie in the same plane, there are formed four edges at the inside 30, whereby said inside produces a "pumping effect" on the materials 6 upon rotation of the bucket 3 so that the materials 6 are "pumped" in a forward direction from the back 7 of the bucket 3. This will bring about a better distribution of the materials 6 in the bucket 3 and counteract that the materials 6 "hang on" to the inside 30 of the back 7 of the bucket 3.

Each triangular part 30*a*–30*d* preferably extends at an angle $\gamma$ of 5°–15°, preferably about 10°, to a line 33 at right angles to the axis of rotation R, but the parts 30*a*–30*d* may extend at other angles to said line 33.

Furthermore, the bucket 3 comprises four corner profile members 34–37 extending in a forward direction from the back 7, which members are symmetrically arranged in relation to the axis of rotation R. At the front the corner profile members 34–37 are welded to a four-sided frame constituting the front part 25 of the bucket 3. Each corner profile member 34–37 as seen in cross section comprises an approximately semicircular central part 38, an open side 39 of which is turned inwardly, facing the interior of the bucket 3. The central part 38 merges in a first outer portion 40 and on an opposite side merges in a second outer portion 41; said outer portions make a right or approximately right angle with one another. Within the semicircular central part 38 of the corner profile member 34–37 is mounted a fixation profile member 42 which over its length has a number of threaded holes 43 for bolts 44.

To said corner profile member 34–37 there are secured grid units 45–48 forming the four sides 10–13 of the separating part. Said grid units 45–48 are of identical size and shape, and each such unit comprises a frame composed of four frame profile members 49–52 of which the two opposed frame profile members 51 and 52 are adapted to be fixed to the corner profile members 34–37, while the frame profile member 49 is adapted to be placed adjacent the back 7 and the frame profile member 50 adjacent the front part 25. Each grid unit 45–48 further comprises a wire grid 54 consisting of metal wires 55 which alternately pass over and below each other to form square apertures 14 or apertures of any other suitable shape, through which the topsoil 4 but not stones, roots and other coarse constituents 5 can pass. The metal wires 55 are suitably fixed to the frame profile members 49–52, for instance in that they are passed into slots in said profile members and then welded thereto.

To permit anchoring of the grid units 45–48 to the corner profile members 34–37 the two frame profile members 51, 52 are provided with laterally directed beads 57. An elongated anchorage profile member 59 with a plurality of holes 60 for bolts 44 is provided at one inner side with two recesses 61, 62 in which the beads 57 of two grid units 45–48 are adapted to engage.

The grid units 45–48 and the corner profile members 34–37 are assembled simply by placing the frame profile members 51 or 52 of two grid units 45–48 adjacent the fixation profile member 42 of the frame profile members, by arranging the anchorage profile member 59 such that the beads 57 engage in its recesses 61, 62 and by securing the anchorage profile member 59 to the fixation profile member 42 in that the bolts 44 are screwed into the holes 43. If the grid units 45–48 have to be exchanged for some reason or other they can be dismounted simply by loosening the bolts 44 and removing the anchorage profile members 59. In this way, damaged grid units 45–48 can easily be exchanged, or grid units with one mesh size can rapidly be replaced by grid units with another mesh size.

The grid units 45–48 may be clamped to the corner profile members 34–37 by means of the bolts 44 or they may be arranged for restricted mobility to permit "shaking off" constituents that have stuck to the metal wires 55. In the embodiment shown in FIG. 11 the grid units 45–48 are fastened in that the anchorage profile member 59 clamps the frame profile members 51 or 52 to the outer portions 40, 41. The grid units 45–48 may, however, be arranged for restricted motion simply in that a washer (not shown) is placed between the anchorage profile member 59 and the fixation profile member 42. Said washer should be so thick that there is formed a gap between the anchorage profile member 59 and the outer portions 40 and 41 which is wider than the frame profile members 51 or 52, whereby said members are able to move back and forth until the bead 57 bears against the anchorage profile member 59 and the fixation profile member 42, respectively.

As mentioned above, the front part 25 of the bucket 3 has a four-sided frame and each frame front side 26–29 consists, adjacent the separating part 9, of a reinforcing profile member 64 having an inwardly directed reinforcing point 65 which to a certain extent also forms a threshold which prevents materials 6 in the separating part 9 falling forwards. In the front part of the reinforcing profile members 64 there are arranged planar, forwardly directed edge elements 66 whose front edges 67 constitute cutting edges serving to facilitate the penetration of the bucket 3 into the materials or products 6 upon their collection.

One, two or three, but not all the sides 10–13 of the separating part 9 may be closed entirely or for the most part. This will make it possible to transport sizable materials or products 6 in the bucket without any risk of their falling out of it. To realize this, the bucket 3 is set so that its closed side will form the underside of the bucket 3, whereupon the bucket 3 is moved into the materials or products 6. After collection, they are transported to the contemplated location without the bucket 3 being rotated.

Figure 1:
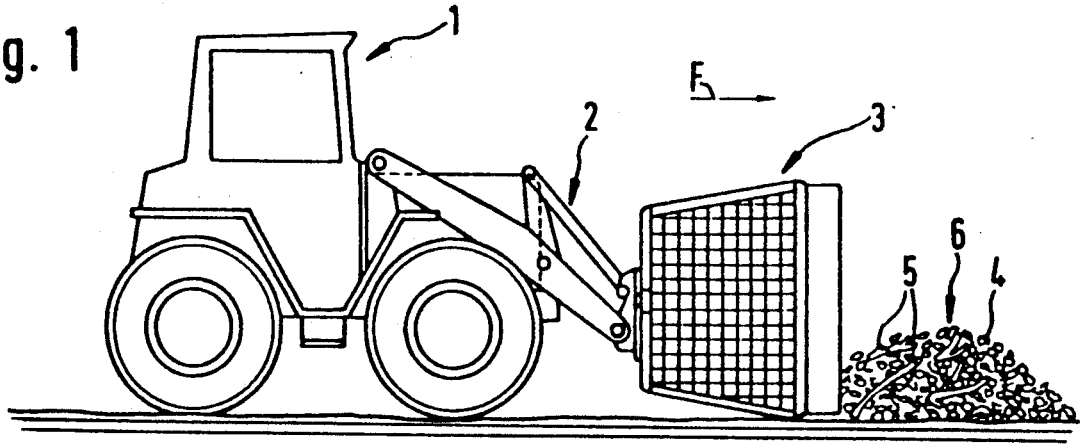
FIG. 1 is a side view showing a tractor equipped with a loading assembly and a bucket according to the invention coupled thereto when the bucket is moved into sizable materials for the collection thereof in the bucket.
Figure 2:
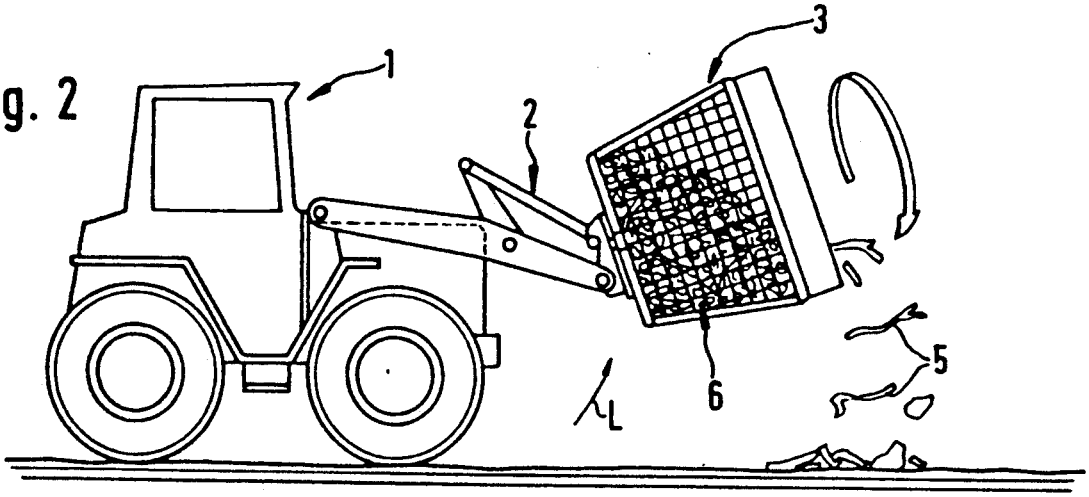
FIG. 2 is a side view of a tractor with raised bucket and materials therein during the introductory rotation for causing very coarse constituents to fall out.
Figure 3:
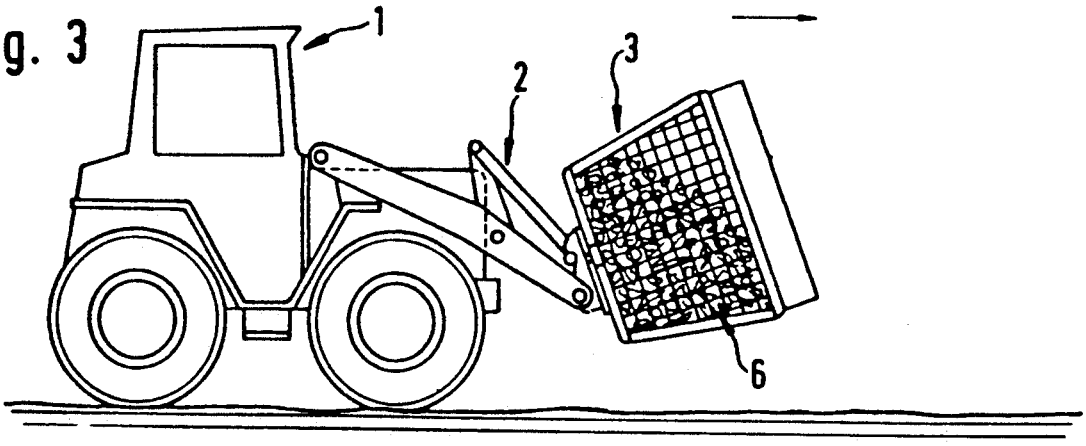
FIG. 3 is a side view of the tractor with raised bucket on its way to a location where fine constituents shall be sized and caused to fall out.
Figure 5:
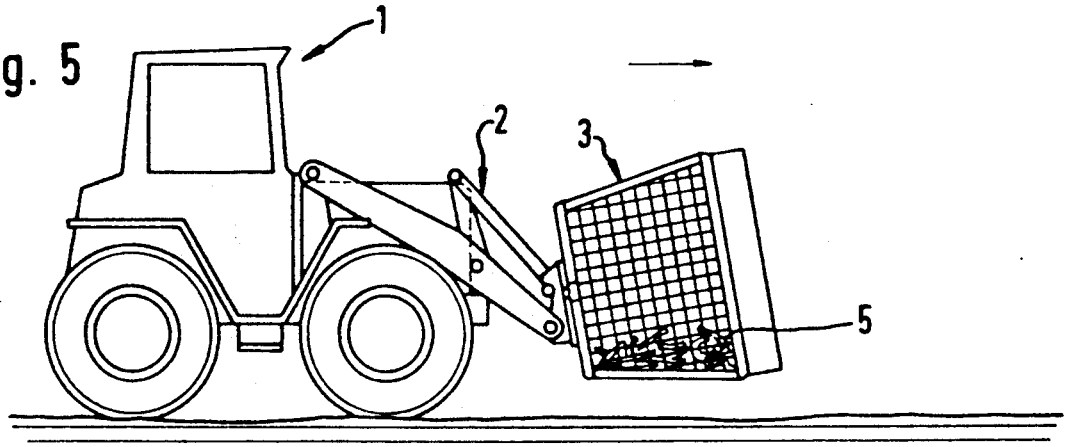
FIG. 5 is a side view of the tractor with raised bucket for transporting the coarse constituents remaining in the bucket after sizing, to a location intended for said coarse constituents.
Figure 6:
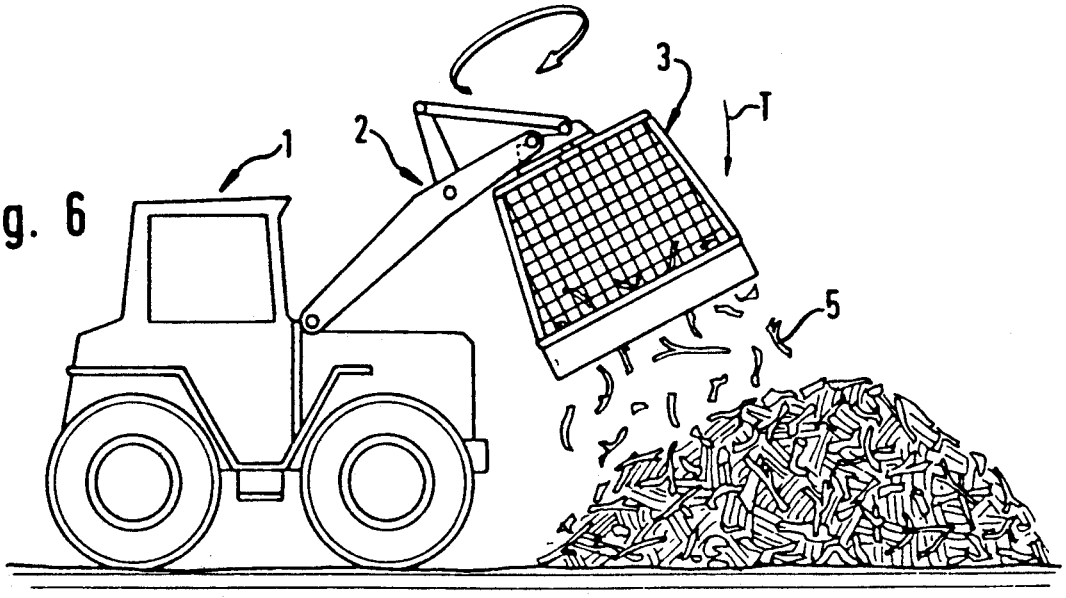
FIG. 6 is a side view of the tractor with the bucket during forward tilting and final rotation to cause the coarse constituents to fall out at said location.

For collection of the unsized topsoil 6 the bucket 3 is lowered until one side 26 of the front part 25 is close to the soil surface 68, extending parallel to it. Then the tractor 1 is driven towards the topsoil pile, whereby the bucket 3 is subjected to shifting movements F, thereby digging into said topsoil pile (FIG. 1). The bucket 3 is then subjected to a lifting movement L and also to a tilting movement until it slants upwardly, whereupon the bucket is caused to rotate some revolutions to cause large roots and the like lying in the front part 25 of the bucket 3, to fall out (FIG. 2). After that the tractor 1, retaining the bucket 3 in the upwardly slanting position is driven to a location where sized topsoil is to be distributed (FIG. 3). On this location the bucket 3 is set in a position earlier described, whereupon sizing is effected (FIG. 4). After finished sizing, only stones, roots and other large constituents remain in the bucket 3 and the tractor 1 is driven to a dump (FIG. 5), where the bucket 3 is tilted forwardly and downwardly as the arrow T indicates and possibly rotated for discharge of the coarse constituents 5 (FIG. 6). Then, fresh, unsized topsoil can be collected for sizing, when the abovementioned cycle is repeated.

The invention is not restricted to the embodiment described above and illustrated in the drawings, but can be varied within the scope of the appendant claims. By way of example of embodiments not described above and not illustrated in the drawings, it may be mentioned that the length of the separating part in relation to the overall length of the bucket may be smaller than that illustrated even though the separating part in general should be as long as possible. The separating part need not have detachable sides and/or detachable grids; these may be fixedly mounted. Furthermore, the separating part may have a number of sides other than four, for instance three sides, five sides, six sides etc., or the separating part may be circular, semicircular or shaped as a segment of a circle. Besides, these various shapes may also apply to the bucket in its entirety.

The inside of the back of the bucket may have a shape other than pyramidal even though such a pyramidal shape is of special advantage. It is essential that the inside constitutes sections and/or edges that break up the inside in such a manner that it is not fully uniform, as seen in a direction around the axis of rotation.

The sides of the front part need not extend symmetrically in relation to the axis of rotation and they need not be uniform as in the embodiment described but may differ with regard to shape and size. All of these sides need not either extend in parallel with or at the same angle to the axis of rotation, but one side may extend in parallel with or at a certain angle to the axis of rotation, while one or more of the other sides extend at another angle to the axis of rotation. It is not either necessary for all of these sides to form cutting edges, but it is fundamentally sufficient if one side forms such an edge.

The rotation assembly may be of a type other than that illustrated, it may be placed in another manner and it may rotate the bucket via a device other than that illustrated. By way of example, the rotation assembly may be an electric motor which is connectable to an electric system in the vehicle.

The implement carriers may be of a suitable type other than those mentioned above, provided that it has the capability to lift, tilt and rotate the bucket.

The bucket may be utilized for sizing sizable materials or products other than topsoil. As an example of such other products, mention may be made of stone material comprising small and large stones to be separated. A further example is products in the form of root crops with adhering soil, such as sugar beets, beetroots or potatoes, the root crops being the large constituents and the soil the small constituents.

The separating part may comprise a rear portion closest to the back of the bucket and a fore portion closest to the front part, whereby said portions diverge at different angles relative to the axis of rotation. The front portion extends parallel with the sides of the front part, i.e. diverge in a lesser degree than the rear portion relative to the axis of rotation, extends parallel with the axis of rotation or converge relative to the axis of rotation.

I claim:

1. A rotary grid-structure bucket for separating from each other fine and coarse constituents of sizable materials a back (7) of the bucket (3) comprising coupling means (15) for coupling the bucket (3) to an implement carrier (1, 2), a front (8) of the bucket (3) being open for collection of the sizable materials (6) in the bucket (3), the bucket (3) comprising a separating part (9) located between the back (7) and the front (8) and having sides (10–13) with apertures (14) therein for allowing fine constituents (4) of the sizable materials to escape therethrough, the implement carrier (1, 2) being adapted to cause the bucket (3) to perform shifting movements (F), lifting movements (L) and tilting movements (T) for collection, lifting and tilting of the sizable materials (6), the bucket (3) cooperating with a rotation assembly (17) for rotating the bucket in relation to the implement carrier (1, 2) about an axis of rotation (R) which extends in a forward direction from the back (7) of the bucket (3) to the front (8) thereof, and the bucket (3) imparting, through its rotation movement to the sizable materials (6) in the bucket, thus causing the fine constituents (4) to drop out of the apertures (14) in the sides (10–13) of the separating part (9) characterized by that the sides of the separating part (9) diverge symmetrically in relation to the axis of rotation (R) in a forward direction, that the bucket (3) ahead of the separating part (9) has a front part (25) with sides (26–29) diverging around the axis of rotation (R) in a forward direction in a lesser degree with respect to the axis of rotation (R) than the sides (10–13) of the separating part (9), and that the implement carrier (1, 2) is adapted during rotation to maintain the bucket (3) such that the momentarily lower most portion (9*a*) of the sides (10–13) of the separating part (9) as seen from the side extend horizontally (H) while the portion (25*a*) of the sides (26–29) of the front part (25), which is momentarily lowermost during rotation, as seen from the side extends in an upward direction (U) to distribute the sizable materials (6) during rotation of the bucket (3) along the separating part (9), while the sizable materials or products (6) are prevented falling out through the front (8) of the bucket (3) in that the momentarily lowermost portion (25*a*) of the sides (26–29) of the front part (25) forms a threshold ahead of the separating part (9).

2. A rotary bucket as claimed in claim 1, characterized by that the sides (10–13) of the separating part (9) diverge at an angle ($\alpha$) of 6°–30° with respect to the axis of rotation (R).

3. A rotary bucket as claimed in claim 1, the bucket (3) having four sides, characterized by that the front part (25) of the bucket (3) comprises a frame formed by four edge elements (66) which are placed symmetrically with respect to the axis of rotation (R) the edge elements having front edges (67) which form cutting edges.

4. A rotary bucket as claimed in claim 1, the bucket (3) comprising a plurality of sides, characterized by that at least one but not all of the sides (10–13) of the separating part (9) are substantially closed to permit transporting sizable materials or products (6) in the bucket (3) without any risk that the materials or products fall out of the bucket (3), and that the open sides of the separating part (9) are provided with grids in the form of metal wire grids (54) which form substantially square apertures (14).

5. A rotary bucket as claimed in claim 1, characterized by that the separating part (9) comprises a rear portion closest to the back (7) of the bucket (3) and a front portion closest to the front part (25), whereby said front portion diverge in a lesser degree than said rear portion relative to the axis of rotation (R).

6. A rotary grid structure bucket for separating from each other fine and coarse constituents of sizable materials, a back (7) of the bucket (3) comprising coupling means (15) for coupling the bucket (3) to an implement carrier (1, 2), a front (8) of the bucket (3) being open for collection of the sizable materials (6) in the bucket (3), the bucket (3) comprising a separating part (9) located between the back (7) and the front (8) and having sides (10–13) with apertures (14) therein for allowing fine constituents (4) of the sizable materials to escape therethrough, the implement carrier (1, 2) being adapted to cause the bucket (3) to perform shifting movements (F), lifting movements (L) and tilting movements (T) for collection, lifting and tilting of the sizable materials (6), the bucket (3) cooperating with a rotation assembly (17) for rotating the bucket in relation to the implement carrier (1, 2) about an axis of rotation (R) which extends in a forward direction from the back (7) of the bucket (3) to the front (8) thereof, and the bucket (3) imparting, through its rotation, movement to the sizable materials (6) in the bucket, thus causing the fine constituents (14) to drop out of the apertures (14) in the sides (10–13) of the separating part (9), characterized by:

that the sides of the separating part (9) diverge symmetrically in relation to the axis of rotation (R) in a forward direction, that the bucket (3) ahead of the separating part (9) has a front part (25) whose sides (26–29) diverge around the axis of rotation (R) in a forward direction in a lesser degree with respect to the axis of rotation (R) than the sides (10–13) of the separating part (9), and that the implement carrier (1, 2) is adapted during rotation to maintain the bucket (3) such that a momentarily lowermost portion (9*a*) of the sides (10–13) of the separating part (9) as seen from the side extend horizontally (H) while a portion (25*a*)

of the sides (26–29) of the front part (25), which is momentarily lowermost during rotation, as seen from the side extends in an upward direction (U) to distribute the sizable materials (6) during rotation of the bucket (3) along the separating part (9), while the sizable materials (6) are prevented from falling out through the front (8) of the bucket (3) in that the momentarily lowermost portion (25*a*) of the sides (26–29) of the front part (25) forms a threshold ahead of the separating part (9), the bucket (3) having a polygonal back (7), characterized by that the inside (30) of the back (7) of the bucket (3) comprises a plurality of triangular parts (28–31) which together constitute a pyramidal inner part of the bucket (3).

7. A rotary bucket as claimed in claim 1, characterized by that the sides (10–13) of the separating part (9) of the bucket (3) are provided with detachably arranged grid units (45–48).

8. A rotary grid-structure bucket for separating from each other fine and coarse constituents of sizable materials, a back (7) of the bucket (3) comprising coupling means (15) for coupling the bucket (3) to an implement carrier (1, 2), a front (8) of the bucket (3) being open for collection of the sizable materials (6) in the bucket (3), the bucket (3) comprising a separating part (9) located between the back (7) and the front (8) and having sides (10–13) with apertures (14) therein for allowing fine constituents (4) of the sizable materials to escape therethrough, the implement carrier (1, 2) being adapted to cause the bucket (3) to perform shifting movements (F), lifting movements (L) and tilting movements (T) for collection, lifting and tilting of the sizable materials (6), the bucket (3) cooperating with a rotation assembly (17) for rotating the bucket in relation to the implement carrier (1, 2) about an axis of rotation (R) which extends in a forward direction from the back (7) of the bucket (3) to the front (8) thereof, and the bucket (3) imparting, through its rotation, movement to the sizable materials (6) in the bucket, thus causing the fine constituents (4) to drop out of the apertures (14) in the sides (10–13) of the separating part (9), characterized by:

that the sides of the separating part (9) diverge symmetrically in relation to the axis of rotation (R) in a forward direction, that the bucket (3) ahead of the separating part (9) has a front part (25) with sides (26–29) diverging around the axis of rotation (R) in a forward direction in a lesser degree with respect to the axis of rotation (R) than the sides (10–13) of the separating part (9), and that the implement carrier (1, 2) is adapted during rotation to maintain the bucket (3) such that the momentarily lowermost portion 9(*a*) of the sides (10–13) of the separating part (9) as seen from the side extend horizontally (H) while a portion (25*a*) of the sides (26–29) of the front part (25), which is momentarily lowermost during rotation as seen from the side extends in an upward direction (U) to distribute the sizable materials (6) during rotation of the bucket (3) along the separating part (9), while the sizable materials (6) are prevented from falling out through the front (8) of the bucket (3) in that the momentarily lowermost portion (25*a*) of the sides (26–29) of the front part (25) forms a threshold ahead of the separating part (9), that the sides (10–13) of the separating part (9) of the bucket (3) are provided with detachably arranged grid units (45–48), that, the separating part (9) of the bucket (3) comprises a plurality of sides (10–13), characterized by that the bucket (3) comprises a plurality of corner profile members (34–37) whose number corresponds to the number of sides (10–13) of the separating part (9) and which are fixedly arranged on the back (7) of the bucket (3) and extend forwardly from said back to the front part (25) of the bucket (3), and that grid units (45–48) comprise frame profile members (51, 52) via which the grid units (45–48) are detachably mounted on the corner profile members (34–37).

9. A rotary bucket as claimed in claim 8, characterized by that at each corner profile member (34–37) there are detachably mounted two grid units (45–48) by means of a longitudinal anchorage profile member (59) which, are arranged for restricted motion between the corner profile member (34–37) and the anchorage profile member (59).

10. A rotary bucket as claimed in claim 9, characterized by that each corner profile member (34–37) in cross section has an approximately semicircular central portion (38) an open side (39) of which is turned inwardly facing the interior of the bucket, said central portion on one side merging in a first outer portion (40) and on an opposite side merging in a second portion (41), which outer portions (40, 41) are at approximately right angles to each other, frame profile members (51, 52) of two grid units (45–48) being anchorable to the corner profile member (34–37) in that the anchorage profile member (59) can be screwed to a fixation profile member (42) arranged within the central portion (38) of the corner profile member (34–37) after the frame profile members (51, 52) have been placed between the outer portions (40, 41) and the anchorage profile member (59), and said frame profile members (51, 52) having beads (57) adapted to lie inside the anchorage profile member (59) and to engage in corresponding recesses (61, 62) in the insides of the anchorage profile member (59).

11. A rotary grid structure bucket for separating from each other fine and coarse constituents of sizable materials, a back (7) of the bucket (3) comprising coupling means (15) for coupling the bucket (3) to an implement carrier (1, 2), a front (8) of the bucket (3) being open for collection of sizable materials (6) in the bucket (3), the bucket (3) comprising a separating part (9) located between the back (7) and the front (8) and having sides (10–13) with apertures (14) therein for allowing fine constituents (4) of the sizable materials to escape therethrough, the implement carrier (1, 2) being adapted to cause the bucket (3) to perform shifting movements (F), lifting movements (L) and tilting movements (T) for collection, lifting and tilting of the sizable materials (6), the bucket (3) cooperating with a rotation assembly (17) for rotating the bucket in relation to the implement carrier (1, 2) about an axis of rotation (R)

which extends in a forward direction from the back (7) of the bucket (3) to the front (8) thereof, and the bucket (3) imparting, through its rotation, movement to the sizable materials (6) in the bucket, thus causing the fine constituents (4) to drop out of the apertures (14) in the sides (10–13) of the separating part (9), characterized by:

that the sides of the separating part (9) diverge symmetrically in relation to the axis of rotation (R) in a forward direction, that the bucket (3) ahead of the separating part (9) has a front part (25) with sides (26–29) around the axis of rotation (R) in a forward direction extending parallel to the axis of rotation (R) and that the implement carrier (1, 2) is adapted during rotation to maintain the bucket (3) such that a momentarily lowermost portion (9*a*) of the sides (10–13) of the separating part (9) as seen from the side extend horizontally (H) while a portion (25*a*) of the sides (26–29) of the front part (25), which is momentarily lowermost during rotation, as seen from the side extends in an upward direction (U) to distribute the sizable materials (6) during rotation of the bucket (3) along the separating part (9), while the sizable materials (6) are prevented from falling out through the front (8) of the bucket (3) in that the momentarily lowermost portion (25*a*) of the sides (26–29) of the front part (25) forms a threshold ahead of the separating part (9), that the sides (10–13) of the separating part (9) of the bucket (3) are provided with detachably arranged grid units (45–48), that the separating part (9) of the bucket (3) comprises a plurality of sides (10–13), characterized by that the bucket (3) comprises a plurality of corner profile members (34–37) whose number corresponds to the number of sides (10–13) of the separating part (9) and which are fixedly arranged on the back (7) of the bucket (3) and extend forwardly from said back to the front part (25) of the bucket (3), and that grid units (45–48) comprise frame profile members (51, 52) via which the grid units (45–48) are detachably mounted on the corner profile members (34–37).

12. A rotary bucket as recited in claim 11 wherein said grid units are clamped to the corner profile member by means of an anchorage profile member.

13. A rotary bucket as claimed in claim 11, characterized by that at each corner profile member (34–37) there are detachably mounted two grid units (45–48) by means of a longitudinal anchorage profile member (59), which are arranged for restricted motion between the corner profile member (34–37) and the anchorage profile member (59).

14. A rotary grid structure bucket for separating from each other fine and coarse constituents of sizable materials, a back (7) of the bucket (3) comprising coupling means (15) for coupling the bucket (3) to an implement carrier (1, 2), a front (8) of the bucket (3) being open for collection of sizable materials (6) in the bucket (3), the bucket (3) comprising a separating part (9) located between the back (7) and the front (8) and having sides (10–13) with apertures (14) therein for allowing fine constituents (4) of the sizable materials to escape therethrough, the implement carrier (1, 2) being adapted to cause the bucket (3) to perform shifting movements (F), lifting movements (L) and tilting movements (T) for collection, lifting and tilting of the sizable materials (6), the bucket (3) cooperating with a rotation assembly (17) for rotating the bucket in relation to the implement carrier (1, 2) about an axis of rotation (R) which extends in a forward direction from the back (7) of the bucket (3) to the front (8) thereof, and the bucket (3) imparting, through its rotation, movement to the sizable materials (6) in the bucket, thus causing the fine constituents (4) to drop out of the apertures (14) in the sides (10–13) of the separating part (9), characterized by:

that the sides of the separating part (9) diverge symmetrically in relation to the axis of rotation (R) in a forward direction, that the bucket (3) ahead of the separating part (9) has a front part (25) with sides (26–29) around the axis of rotation (R) in a forward direction converging toward the axis of rotation (R) and that the implement carrier (1, 2) is adapted during rotation to maintain the bucket (3) such that a momentarily lowermost portion (9*a*) of the sides (10–13) of the separating part (9) as seen from the side extend horizontally (H) while a portion (25*a*) of the sides (26–29) of the front part (25), which is momentarily lowermost during rotation, as seen from the side extends in an upward direction (U) to distribute the sizable materials (6) during rotation of the bucket (3) along the separating part (9), while the sizable materials (6) are prevented from falling out through the front (8) of the bucket (3) in that the momentarily lowermost portion (25*a*) of the sides (26–29) of the front part (25) forms a threshold ahead of the separating part (9), that the sides (10–13) of the separating part (9) of the bucket (3) are provided with detachably arranged grid units (45–48), that the separating part (9) of the bucket (3) comprises a plurality of sides (10–13), characterized by that the bucket (3) comprises a plurality of corner profile members (34–37) whose number corresponds to the number of sides (10–13) of the separating part (9) and which are fixedly arranged on the back (7) of the bucket (3) and extend forwardly from said back to the front part (25) of the bucket (3), and that the grid units (45–48) comprises frame profile members (51, 52) via which the grid units (45–48) are detachably mounted on the corner profile members (34–37), and further characterized by that at each corner profile member (34–37) there are detachably mounted two grid units (45–48) by means of a longitudinal anchorage profile member (59), which are arranged for restricted motion between the corner profile member (34–37) and the anchorage profile member (59).

15. A rotary grid-structure bucket for separating from each other fine and coarse constituents of sizable materials, a back (7) of the bucket (3) comprising coupling means (15) for coupling the bucket (3) to an implement carrier (1, 2), a front (8) of the bucket (3) being open for collection of the sizable materials (6) in the bucket (3), the bucket (3) comprising a separating part (9) located between the back (7) and the front (8) and having sides (10–13) with apertures (14) therein for allowing fine constituents (4) of the sizable materials to escape therethrough.

the implement carrier (1, 2) being adapted to cause the bucket (3) to perform shifting movements (F), lifting movements (L) and tilting movements (T) for collection, lifting and tilting of the sizable materials (6), the bucket (3) cooperating with a rotation assembly (17) for rotating the bucket in relation to the implement carrier (1, 2) about an axis of rotation (R) which extends in a forward direction from the back (7) of the bucket (3) to the front (8) thereof, and the bucket (3) imparting, through its rotation, movement to the sizable materials (6) in the bucket, thus causing the fine constituents (4) to drop out of the apertures (14) in the sides (10–13) of the separating part (9), characterized by that the bucket (3) ahead of the separating part (9) has a front part (25) whose sides (26–29) diverge around the axis of rotation (R) in a forward direction in a lesser degree with respect to the axis of rotation (R) than the sides (10–13) of the separating part (9), that the separating part (9) comprises a rear portion closest to the back of the bucket (7) and a front portion closest to the front part (25) said front portion extending parallel with said axis of rotation, and that the implement carrier (1, 2) is adapted during rotation to maintain the bucket (3) such that the momentarily lowermost portion (9*a*) of the sides (10–13) of the separating part (9) as seen from the side extend horizontally (H) while the portion (25*a*) of the sides (26–29) of the front part (25), which is momentarily lowermost during rotation. as seen from the side extends in an upward direction (U) to distribute the sizable materials (6) during rotation of the bucket (3) along the separating part (9), while the sizable materials or products (6) are prevented falling out through the front (8) of the bucket (3) in that the momentarily lowermost portion (25*a*) of the sides (26–29) of the front part (25) forms a threshold ahead of the separating part (9).

16. A rotary grid-structure bucket for separating from each other fine and coarse constituents of sizable materials, a back (7) of the bucket (3) comprising coupling means (15) for coupling the bucket (3) to an implement carrier (1, 2), the front (8) of the bucket (3) being open for collection of the sizable materials (6) in the bucket (3).

the bucket (3) comprising a separating part (9) located between the back (7) and the front (8) and having sides (10–13) with apertures (14) therein for allowing fine constituents (4) of the sizable materials to escape therethrough, the implement carrier (1, 2) being adapted to cause the bucket (3) to perform shifting movements (F), lifting movements (L) and tilting movements (T) for collection, lifting and tilting of the sizable materials (6), the bucket (3) cooperating with a rotation assembly (17) for rotating the bucket in relation to the implement carrier (1, 2) about an axis of rotation (R) which extends in a forward direction from the back (7) of the bucket (3) to the front (8) thereof, and the bucket (3) imparting, through its rotation, movement to the sizable materials (6) in the bucket, thus causing the fine constituents (4) to drop out of the apertures (14) in the sides (10–13) of the separating part (9)

characterized by that the bucket (3) ahead of the separating part (9) has a front part (25) whose sides (26–29) diverge around the axis of rotation (R) in a forward direction in a lesser degree with respect to the axis of rotation (R) than the sides (10–13) of the separating part (9), that the separating part (9) comprises a rear portion closest to the back of the bucket (7) and a front portion closest to the front part (25) said front portion converging relative to said axis of rotation, and that the implement carrier (1, 2) is adapted during rotation to maintain the bucket (3) such that the momentarily lowermost portion (9*a*) of the sides (10–13) of the separating part (9) as seen from the side extend horizontally (H) while the portion (25*a*) of the sides (26–29) of the front part (25), which is momentarily lowermost during rotation, as seen from the side extends in an upward direction (U) to distribute the sizable materials (6) during rotation of the bucket (3) along the separating part (9), while the sizable materials or products (6) are prevented falling out through the front (8) of the bucket (3) in that the momentarily lowermost portion (25*a*) of the sides (26–29) of the front part (25) forms a threshold ahead of the separating part (9).

17. A rotary grid-structure bucket for separating from each other fine and coarse constituents of sizable materials, a back (7) of the bucket (3) comprising coupling means (15) for coupling the bucket (3) to an implement carrier (1, 2), a front (8) of the bucket (3) being open for collection of the sizable materials (6) in the bucket (3), the bucket (3) comprising a separating part (9) located between the back (7) and the front (8) and having sides (10–13) with apertures (14) therein for allowing fine constituents (4) of the sizable materials to escape therethrough, the implement carrier (1, 2) being adapted to cause the bucket (3) to perform shifting movements (F), lifting movements (L) and tilting movements (T) for collection, lifting and tilting of the sizable materials (6), the bucket (3) cooperating with a rotation assembly (17) for rotating the bucket in relation to the implement carrier (1, 2) about an axis of rotation (R) which extends in a forward direction from the back (7) of the bucket (3) to the front (8) thereof, and the bucket (3) imparting, through its rotation, movement to the sizable materials (6) in the bucket, thus causing the fine constituents (4) to drop out of the apertures (14) in the sides (10–13) of the separating part (9)

characterized by that the sides of the separating part (9) diverge symmetrically in relation to the axis of rotation (R) in a forward direction, that the bucket (3) ahead of the separating part (9) has a front part (25) with sides (26–29) around the axis of rotation (R) in a forward direction extending in parallel with the axis of rotation (R), and that the implement carrier (1, 2) is adapted during rotation to maintain the bucket (3) such that the momentarily lowermost portion (9*a*) of the sides (10–13) of the separating part (9) as seen from the side extend horizontally (H) while the portion (25*a*) of the sides (26–29) of the front part (25), which is momentarily lowermost during rotation, as seen from the side extends in an upward direction (U) to distribute the sizable materials (6) during rotation of the bucket (3) along the separating part (9), while the sizable materials or products (6) are prevented falling out through the front (8) of the bucket (3) in that the momentarily lowermost portion (25*a*) of the sides (26–29) of the front part (25) forms a threshold ahead of the separating part (9).

18. A rotary grid structure bucket for separating from each other fine and coarse constituents of sizable materials.

a back (7) of the bucket (3) comprising coupling means (15) for coupling the bucket (3) to an implement carrier (1, 2), a front (8) of the bucket (3) being open for collection of sizable materials (6) in the bucket (3), the bucket (3) comprising a separating part (9) located between the back (7) and the front (8) and having sides (10–13) with apertures (14) therein for allowing fine constituents (4) of the sizable materials to escape therethrough, the implement carrier (1, 2) being adapted to cause the bucket (3) to perform shifting movements (F), lifting movements (L) and tilting movements (T) for collection, lifting and tilting of the sizable materials (6), the bucket (3) cooperating with a rotation assembly (17) for rotating the bucket in relation to the implement carrier (1, 2) about an axis of rotation (R) which extends in a forward direction from the back (7) of the bucket (3) to the front (8) thereof, and the bucket (3) imparting, through its rotation, movement to the sizable materials (6) in the bucket, thus causing the fine constituents (4) to drop out of the apertures (14) in the sides (10–13) of the separating part (9), characterized by:

that the sides of the separating part (9) diverge symmetrically in relation to the axis of rotation (R) in a forward direction, that the bucket (3) ahead of the separating part (9) has a front part (25) with sides (26–29) around the axis of rotation (R) in a forward direction extending parallel to the axis of rotation (R) and that the implement carrier (1, 2) is adapted during rotation to maintain the bucket (3) such that a momentarily lowermost portion (9*a*) of the sides (10–13) of the separating part (9) as seen from the side extend horizontally (H) while a portion (25*a*) of the sides (26–29) of the front part (25), which is momentarily lowermost during rotation, as seen from the side extends in an upward direction (U) to distribute the sizable materials (6) during rotation of the bucket (3) along the separating part (9), while the sizable materials (6) are prevented from falling out through the front (8) of the bucket (3) in that the momentarily lowermost portion (25*a*) of the sides (26–29) of the front part (25) forms a threshold ahead of the separating part (9), the bucket (3) having a polygonal back (7), characterized by that the inside (30) of the back (7) of the bucket (3) comprises a plurality of triangular parts (28–31) which together constitute a pyramidal inner part of the bucket (3).

* * * * *